US005236331A

United States Patent [19]

Liu

[11] Patent Number: 5,236,331

[45] Date of Patent: Aug. 17, 1993

[54] TERMINAL POSITIONING MEANS OF TERMINAL COUPLING TOOL

[76] Inventor: Lien-Huang Liu, No. 17, Alley 166, Lane 68, Sua-Yuan Rd., Feng-Yuan City, Taichung Hsien, Taiwan

[21] Appl. No.: 857,160

[22] Filed: Mar. 25, 1992

[51] Int. Cl.[5] ..... H01R 43/042

[52] U.S. Cl. ..... 72/461; 72/410; 29/751

[58] Field of Search ..... 72/410, 409, 414–416, 72/461; 29/751; 81/421, 424.5

[56] References Cited

U.S. PATENT DOCUMENTS

| | | | |
|---|---|---|---|
| 2,086,400 | 7/1937 | Brenizer | 72/410 |
| 2,829,549 | 4/1958 | Demler | 29/751 |
| 3,199,334 | 8/1965 | Holmes | 72/410 |
| 3,457,764 | 7/1969 | McKee | 72/410 |
| 3,673,848 | 7/1972 | Filia | 72/410 |
| 3,710,611 | 1/1973 | Filia | 29/751 |
| 4,637,242 | 1/1987 | Undin | 72/410 |
| 4,982,594 | 1/1991 | Wiebe | 72/410 |

FOREIGN PATENT DOCUMENTS

| | | | |
|---|---|---|---|
| 585508 | 2/1947 | United Kingdom | 72/410 |

*Primary Examiner*—Daniel C. Crane
*Attorney, Agent, or Firm*—Browdy and Neimark

[57] ABSTRACT

A terminal coupling tool comprises a plurality of first fastening portions, a plurality of second fastening portions, and a receiving portion disposed on each of the second fastening portions. The receiving portion has an open end positioned correspondingly to an outer end of clamping tooth for allowing one end of the terminal intended to be coupled to be positioned securely in the receiving portion without the help of an operator's hand.

2 Claims, 4 Drawing Sheets

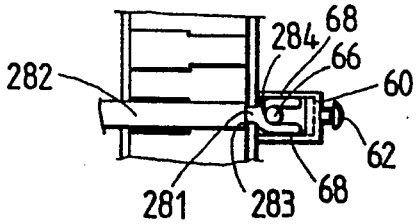
FIG. 7
FIG. 8
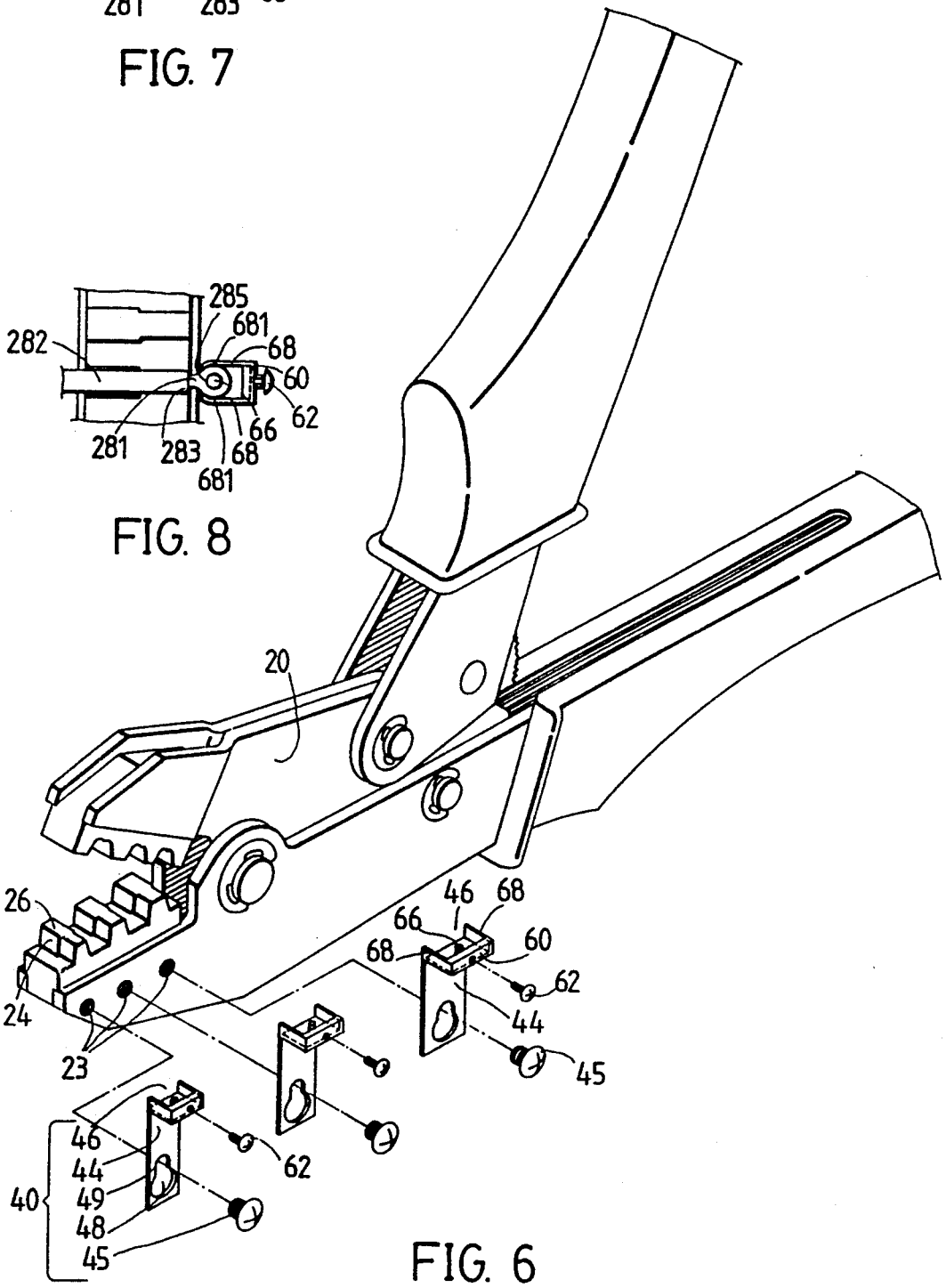
FIG. 6

TERMINAL POSITIONING MEANS OF TERMINAL COUPLING TOOL

BACKGROUND OF THE INVENTION

The present invention relates to a terminal coupling tool, and more particularly to terminal positioning means of a terminal coupling tool.

As shown in FIG. 1, a terminal pliers 10 of prior art is provided with clamping teeth 12 serving to receive therein one end of a terminal 14 holding a wire 16 with its insulation sheath 15 stripped. The other end of the terminal 14 is arranged in such a manner that it extends beyond the side of the terminal pliers 10. It is often difficult to stabilize the terminal 14 on the clamping teeth 12 which have relatively small holding area. As a result, an operator is required to hold firmly not only the terminal pliers 10 but also the terminal 14 and the wire 16 so as to prevent the terminal 14 from moving aside or the wire 16 from tripping. Therefore, it is often difficult for an operator to do a good job with such terminal pliers 10, which has an inherent structural defect. In addition, an operator using such terminal coupling tool of prior art is vulnerable to injury, while the quality of the job done is greatly compromised.

SUMMARY OF THE INVENTION

It is therefore the primary objective of the present invention to provide a terminal coupling tool with terminal positioning means, which can be installed thereto and dismantled therefrom freely, for stabilizing a terminal intended to be coupled on the clamping teeth.

In keeping with the principles of the present invention, the foregoing objective of the present invention is accomplished by a terminal coupling tool, which comprises mainly a plurality of the first fastening portions, a plurality of the second fastening portions, and a receiving portion disposed on each of the second fastening portions. The receiving portion has an open end positioned correspondingly to an outer end of the clamping tooth for allowing one end of the terminal intended to be coupled to be positioned securely in the receiving portion without the help of an operator's hand.

BRIEF DESCRIPTION OF THE DRAWINGS

FIG. 6 shows an exploded view of a third preferred embodiment of the present invention.

FIG. 7 shows a first sectional view of the third preferred embodiment of the present invention in combination.

FIG. 8 shows a second sectional view of the third preferred embodiment of the present invention in combination.

DETAILED DESCRIPTION OF THE PREFERRED EMBODIMENTS

Figure 1:
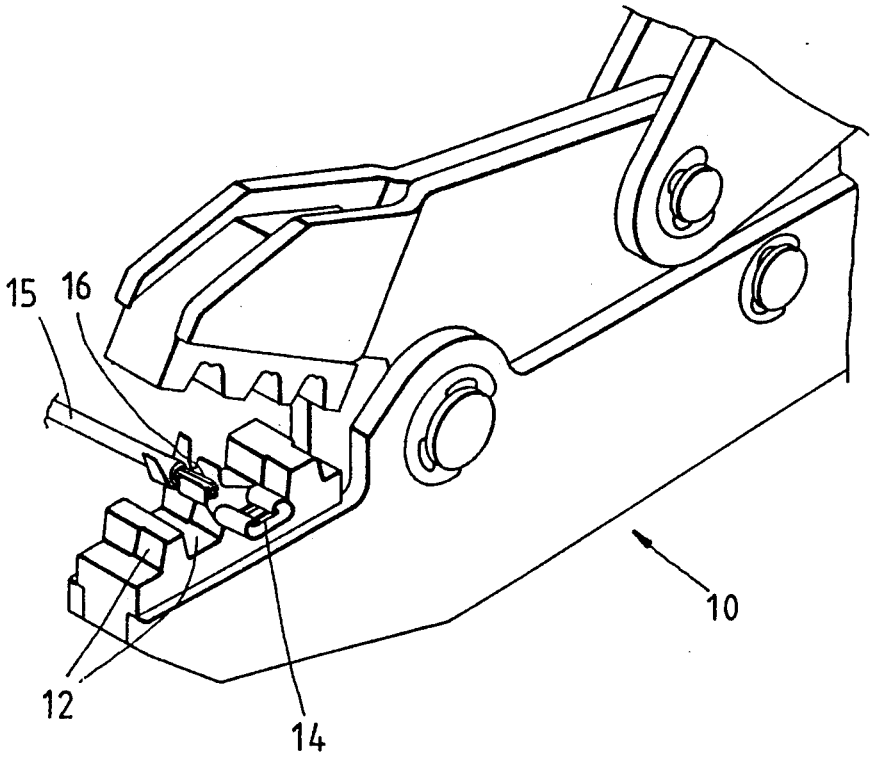
FIG. 1 PRIOR ART
FIG. 1 shows a three-dimensional schematic view of a conventional terminal pliers of prior art.
Figure 3:
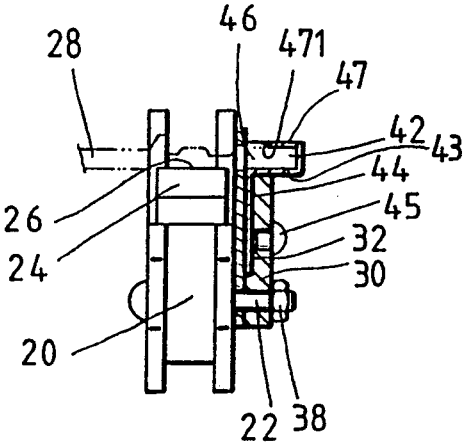
FIG. 3 shows a sectional view of the first preferred embodiment of the present invention in combination.
Figure 2:
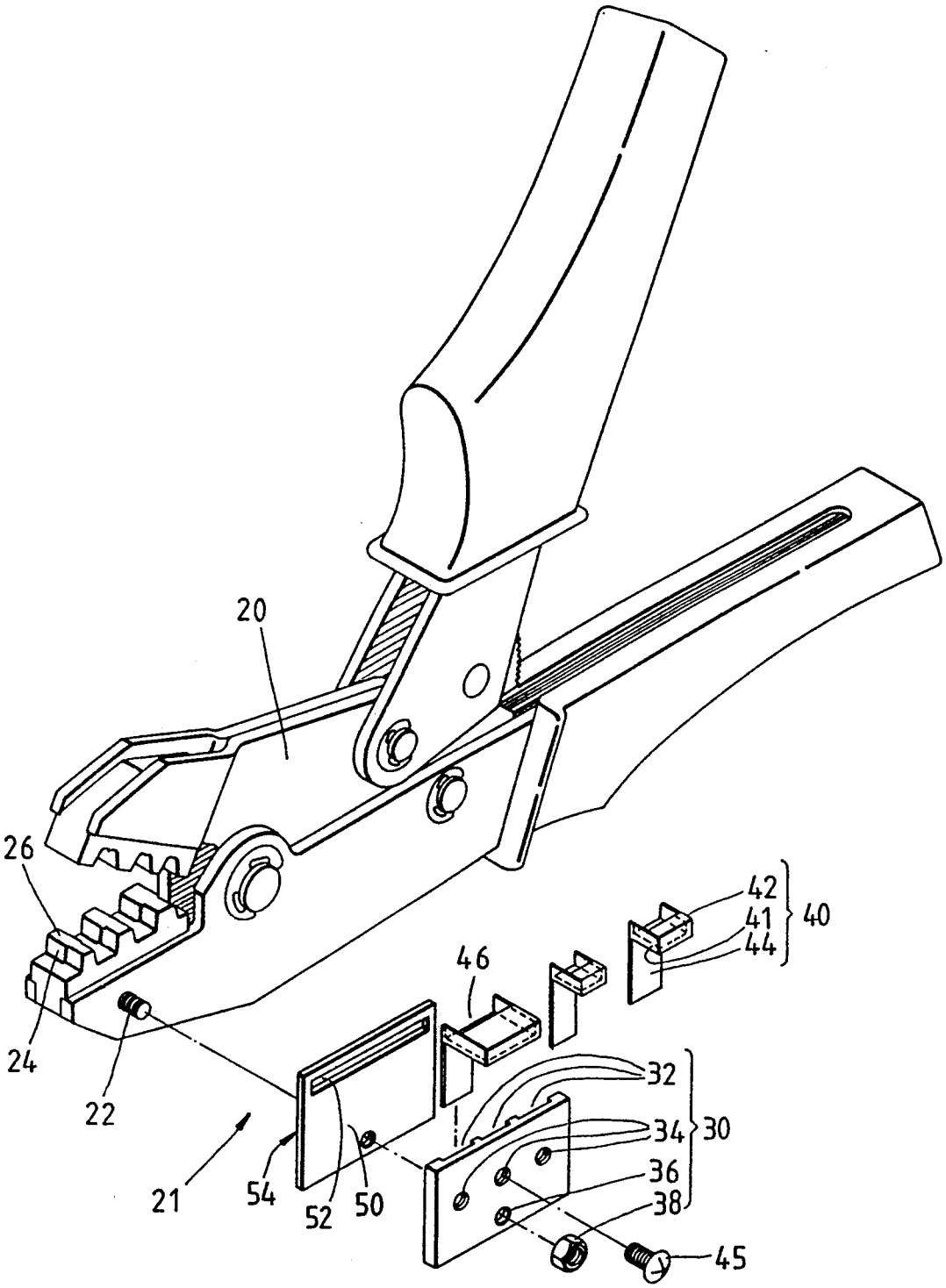
FIG. 2 shows an exploded view of a first preferred embodiment of the present invention.

Referring to FIGS. 2 and 3, a terminal positioning means 21 embodied in the present invention is shown comprising a threaded rod 22 fastened to a side of a terminal pliers 20, a base 30 fastened to the threaded rod 22, three positioning pieces 40 inserted separately into the base 30, and a stopping piece 50 fastened between the terminal pliers 20 and the base 30.

The base 30 of rectangular plate has three slots 32, three threaded holes 34, and a first through hole 36. Each of the three slots 32 is made integrally with the base 30, while each of the three threaded holes 34 is so located that it corresponds to the mid-section of the slot 32. The first through hole 36 is located below the threaded holes 34 and is engageable with the threaded rod 22 which in turn engages with a nut 38.

Each of the positioning pieces 40 is of an inverted L construction and is provided with a receiving portion 42 and a fastening portion 44. The receiving portion 42 has an open end 46 with a tapered face 471 located at the outer edge of inner wall of top end 47 thereof. The fastening portion 44 of a predetermined length and a predetermined width extends downward and vertically from the outer edge of bottom end 43 of the open end 46 so that it can be inserted into the slot 32 of the base 30 in such a manner that it is pressed on by a screw 45 passing through the threaded hole 34.

The stopping piece 50 has a through hole 52 located correspondingly to the threaded rod 22 and fastened between the side of terminal pliers 20 and the base 30. In addition, the stopping piece 50 is provided with an elongate through hole 52 located correspondingly to the holding faces 26 of clamping teeth 24.

In combination, each of slots 32 of the base 30 is positioned correspondingly to each of clamping teeth 24 of the terminal pliers 20 and receives therein the receiving portion 42 in such a manner that the inner edge of the bottom end of the receiving portion 42 is tangent to the holding face 26 of clamping tooth 24 so as to permit a clamped end 281 of a terminal 28 to extend beyond the side of terminal plier 20 to be received in the receiving portion 42 in order to prevent the terminal 28 from moving aside on the holding face 26 of the clamping tooth 24. When the clamped end 281 of the terminal 28 passes through the elongate through hole 52 to enter the receiving portion 42, the shoulder 283 located between the clamped end 281 and the guide end 282 is stopped by the end face 54 of the stopping piece 50 so that the length of the clamped end 281 extending outwardly is regulated.

Figure 5:
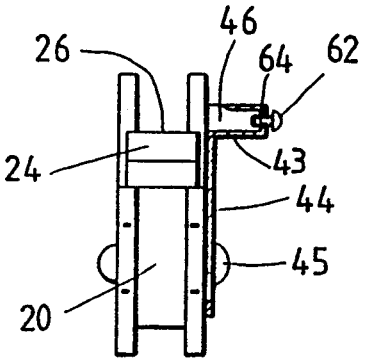
FIG. 5 shows a sectional view of the second preferred embodiment of the present invention in combination.
Figure 4:
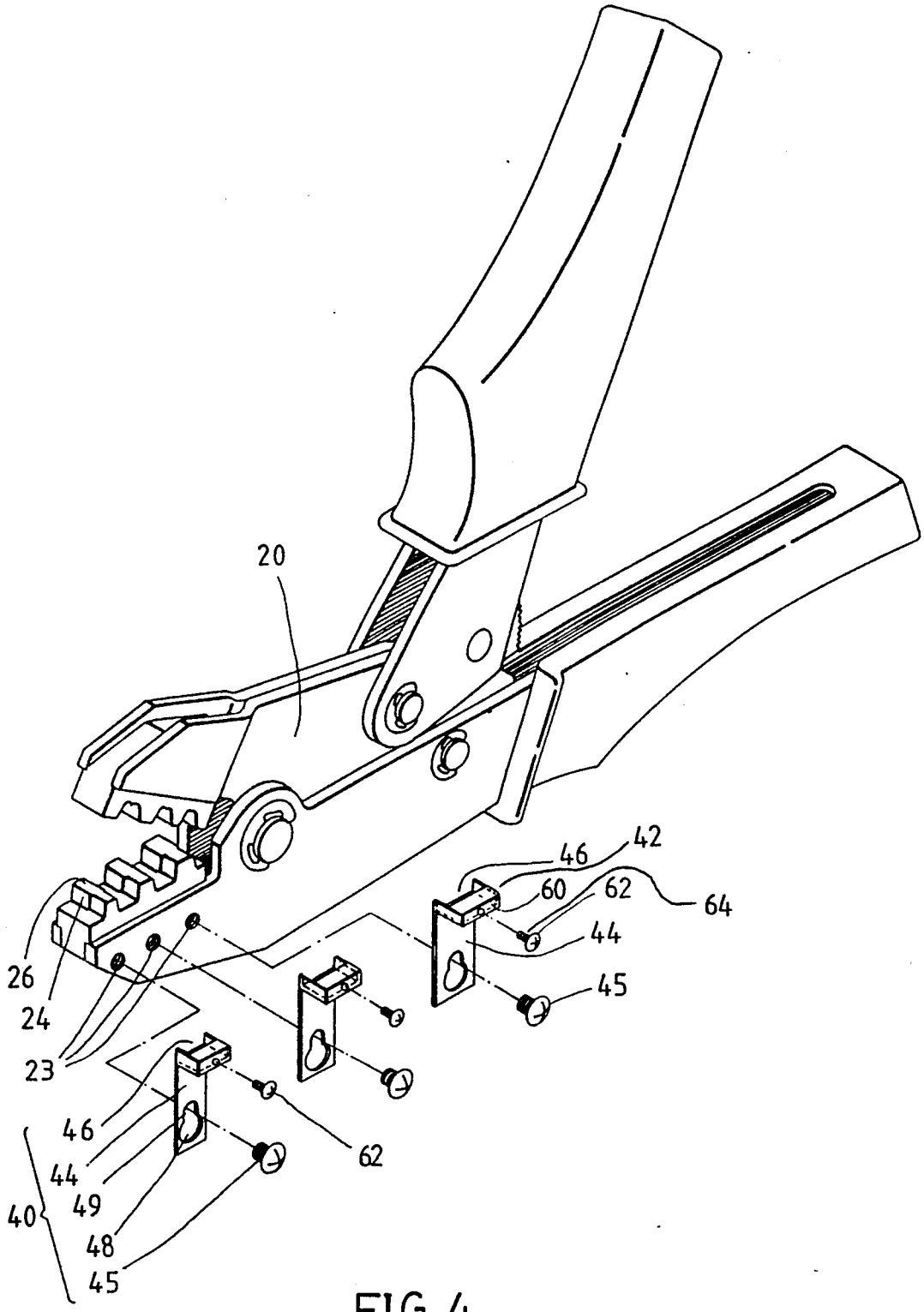
FIG. 4 shows an exploded view of a second preferred embodiment of the present invention.

Now referring to FIGS. 4 and 5 showing the second preferred embodiment of the present invention, a fastening portion 44 of the positioning piece 40 is shown comprising a second through hole 48 having a diameter greater than the head diameter of the screw 45. There are threaded holes 23 in one side of terminal pliers, which are located correspondingly to the clamping teeth 24 and are intended to engage the screws 45. The positioning piece 40 is further provided with a long hole 49 having a size smaller than the outer diameter of the head of the screw 45 but larger than the shank diameter of the screw 45 so as to permit the screw 45 to be prefastened to the threaded hole 23. The open ends 46 of the receiving portion 42 have different widths so as to allow the terminals 28 having different sizes to be positioned thereinto.

The length of the portion of terminal 28 that is received in the receiving portion 42 can be adjusted by regulating the length of the tail end 64 of adjusting screw 62 that is allowed to extend into the receiving portion 42 having a closed end 60 opposite to the open end 46.

As shown in FIGS. 6 and 7, a terminal positioning means 21 of the third embodiment of the present invention comprises a retaining column 66 made integrally with the receiving portion 42 and located centrally at the bottom end 43 of the receiving portion 42. The retaining column 66 extends upwardly and vertically without making contact with the top end 47 of the receiving portion 42 so that the terminal 28 can be secured in place by means of the branched portion 284 or the axial center 285 pressing against the retaining column 66 when the Y-shaped or O-shaped clamped end 281 of the terminal 28 is received in the receiving portion 42. In addition, the two opposite walls 68 of the receiving portion 42 have arcuate tail ends 681 facing toward the terminal plier 20 and making the receiving portion 42 in a better condition to receive therein a terminal 28 having an O-shaped clamped end 281.

The embodiments of the present invention described above are to be considered in all respects as illustrative and not restrictive. Accordingly, the present invention is to be limited only by the scope of the hereinafter appended claims.

What is claimed is:

1. A terminal positioning means of a terminal crimping tool comprising:

a receiving portion and a fastening portion;

said receiving portion including two lateral sides opposite to each other, a bottom side connecting said lateral sides, an open end formed by a first end of said lateral sides and a first end of said bottom side, and an end side opposite said open end engaged to a second end of said bottom side and adjoining a second end of said lateral sides, said two lateral sides, bottom side and end side all being fixed relative to one another;

wherein said receiving portion provides a receiving area in which a terminal may be placed between said lateral sides, said bottom side and said end side, a length of the receiving area being defined as the distance from said end side to the open end at the first ends of said lateral sides and bottom side;

said fastening portion engaged to said first end of said bottom side and extending for a predetermined length in a direction away from said lateral sides, said fastening portion including attachment means for connecting said fastening portion to a crimping tool to permit said open end of said receiving portion to be positioned opposite an outer side of a clamping tooth of said crimping tool and allow an end of a terminal, which is positioned on the clamping tooth, to be received in said area;

said attachment means including a first hole in communication with a second hole and a screw having a head which has a larger diameter than a shank, wherein when said screw is attached to said crimping tool said head can pass through said second hole and said shank can pass into said first hole with said head being incapable of passing through said first hole, said second hole providing removable engagement of said fastening portion to said crimping tool; and wherein said closed end side is provided with spacing means movable with respect to said lateral sides and said end side to selected fixed positions for adjusting a length of said area to control the length of said terminal in said area.

2. A terminal positioning means according to claim 1 wherein said two lateral sides include arcuate tail ends on said first end of said lateral sides.

* * * * *